US011846484B2

(12) United States Patent
Nedev

(10) Patent No.: US 11,846,484 B2
(45) Date of Patent: Dec. 19, 2023

(54) FIREARM WITH GAS PISTON ASSEMBLY

(71) Applicant: Caracal International, LLC, Abu Dhabi (AE)

(72) Inventor: Konstantin Nedev, Abu Dhabi (AE)

(73) Assignee: CARACAL INTERNATIONAL, LLC, Abu Dhabi (AE)

( * ) Notice: Subject to any disclaimer, the term of this patent is extended or adjusted under 35 U.S.C. 154(b) by 0 days.

(21) Appl. No.: 17/551,361

(22) Filed: Dec. 15, 2021

(65) Prior Publication Data

US 2022/0196354 A1 Jun. 23, 2022

Related U.S. Application Data

(60) Provisional application No. 63/128,250, filed on Dec. 21, 2020.

(51) Int. Cl.

| | |
|---|---|
| ***F41A 5/26*** | (2006.01) |
| ***F41A 5/18*** | (2006.01) |
| ***F41A 5/28*** | (2006.01) |

(52) U.S. Cl.
CPC ..... *F41A 5/28* (2013.01); *F41A 5/18* (2013.01); *F41A 5/26* (2013.01)

(58) Field of Classification Search
CPC ..... F41A 5/18; F41A 5/26; F41A 5/28
See application file for complete search history.

(56) References Cited

U.S. PATENT DOCUMENTS

| | | | | |
|---|---|---|---|---|
| 3,246,567 A * | 4/1966 | Miller | F41A 5/26 | 89/191.01 |
| 4,244,273 A * | 1/1981 | Langendorfer, Jr. | F41A 5/18 | 89/193 |
| 4,635,530 A * | 1/1987 | Weldle | F41A 15/14 | 89/193 |
| 7,461,581 B2 * | 12/2008 | Leitner-Wise | F41A 3/12 | 89/191.01 |
| 8,161,864 B1 * | 4/2012 | Vuksanovich | F41A 5/26 | 89/193 |
| 8,505,433 B2 | 8/2013 | Hochstrate et al. | | |

(Continued)

FOREIGN PATENT DOCUMENTS

| | | |
|---|---|---|
| CA | 2670975 A1 | 1/2010 |
| FR | 1286037 A * | 3/1962 |

*Primary Examiner* — Gabriel J. Klein
(74) *Attorney, Agent, or Firm* — Bennet K. Langlotz; Langlotz Patent & Trademark Works, LLC

(57) ABSTRACT

Firearms with gas piston assemblies have a receiver defining a passage receiving a reciprocating bolt assembly, a barrel defining a barrel axis and extending from the receiver in a forward direction and defining a barrel gas aperture, a gas block connected to the barrel and defining a piston bore in communication with the gas block bore, a piston assembly having a forward end operably engaged to the piston bore and a rear end operably engaged to the reciprocating bolt assembly, the piston assembly having a piston closely received in the piston bore and having a piston rear end, the piston assembly including an elongated intermediate rod having an intermediate rod forward end registered with the piston rear end and an intermediate rod rear end, and the piston assembly including a rear portion having a forward end registered with the intermediate rod rear end and a rear portion.

14 Claims, 8 Drawing Sheets

(56) References Cited

U.S. PATENT DOCUMENTS

| | | | | |
|---|---|---|---|---|
| 2007/0199435 | A1* | 8/2007 | Hochstrate | F41G 11/003 42/72 |
| 2008/0276797 | A1* | 11/2008 | Leitner-Wise | F41A 5/18 89/191.01 |
| 2009/0223357 | A1* | 9/2009 | Herring | F41A 5/18 89/193 |
| 2010/0000400 | A1* | 1/2010 | Brown | F41A 5/18 42/111 |
| 2012/0085226 | A1* | 4/2012 | Thiele | F41A 5/18 89/191.01 |
| 2014/0182450 | A1* | 7/2014 | Boutin, Jr. | F41A 5/18 89/193 |

* cited by examiner

FIREARM WITH GAS PISTON ASSEMBLY

CROSS-REFERENCE TO RELATED APPLICATION

This application claims the benefit of U.S. Provisional Patent Application No. 63/128,250 filed on Dec. 21, 2020, entitled "Gas Piston Assembly," which is hereby incorporated by reference in its entirety for all that is taught and disclosed therein.

FIELD OF THE INVENTION

The present invention relates to firearms, and more particularly to a semi-automatic firearm with an adjustable gas block regulator to change the back flow pressure depending on suppressed or unsuppressed operation of the firearm. The semi-automatic firearm also includes a gas piston assembly that is less sensitive to gas block to upper receiver hole angular or concentricity deviation.

BACKGROUND AND SUMMARY OF THE INVENTION

Gas-operated semi-automatic rifles use a portion of the high-pressure combustion gas from the cartridge being fired to power a bolt carrier group to eject the empty cartridge and feed the next cartridge. Most prior art gas systems consist of a gas block rigidly attached to the barrel, where the gas block incorporates an integral gas cylinder and a gas piston housed within the gas cylinder that acts upon the bolt carrier group to cycle to load a new round after the previous round was fired. There is also an orifice communicating with the bore of the barrel and the gas cylinder. The pressure of the gas entering the gas block can vary depending on the presence or absence of a suppressor on the muzzle of the semi-automatic rifle. A suppressor can impede the exit of gas from the muzzle, resulting in higher back flow pressure into the gas block relative to unsuppressed operation. If the gas block is tuned for unsuppressed operation, the gas pressure may cause the gas piston to exert excessive force on the bolt carrier group during unsupressed operation, resulting in excessive wear. If the gas block is tuned for suppressed operation, the gas pressure may be insufficient to enable the gas piston to reliably act upon the bolt carrier group during unsuppressed operation. Prior art adjustable rotary-type gas regulators exist, but they can be difficult to change between settings.

Prior art gas piston assemblies are vulnerable to inappropriate operation in the event of excessive gas block to upper receiver hole angular or concentricity deviation that could cause the back flow pressure to fluctuate. Prior art gas piston assemblies are also vulnerable to longitudinal loads exceeding their limit of flexure if they are not designed with a sufficient length-to-diameter ratio. This requirement poses challenges with rifles firing higher caliber cartridges that require a longer distance between the upper receiver and the orifice communicating with the bore of the barrel to obtain the correct gas pressure to cycle the action reliably without causing excessive wear.

Therefore, a need exists for a new and improved semi-automatic firearm with a switch-type adjustable gas block regulator to change the back flow pressure depending on suppressed or unsuppressed operation of the firearm that is more ergonomic for the user. A need also exists for a new and improved semi-automatic firearm that includes a gas piston assembly that is less sensitive to gas block to upper receiver hole angular or concentricity deviation. In this regard, the various embodiments of the present invention substantially fulfill at least some of these needs. In this respect, the firearm with gas piston assembly according to the present invention substantially departs from the conventional concepts and designs of the prior art, and in doing so provides an apparatus primarily developed for the purpose of enabling the gas block regulator to change the back flow pressure depending on suppressed or unsuppressed operation of the firearm and enabling the gas piston assembly to be less sensitive to gas block to upper receiver hole angular or concentricity deviation.

The present invention provides an improved firearm with gas piston assembly, and overcomes the above-mentioned disadvantages and drawbacks of the prior art. As such, the general purpose of the present invention, which will be described subsequently in greater detail, is to provide an improved firearm with gas piston assembly that has all the advantages of the prior art mentioned above.

To attain this, the preferred embodiment of the present invention essentially comprises a receiver defining a passage receiving a reciprocating bolt assembly, a barrel defining a barrel axis and extending from the receiver in a forward direction and defining a barrel gas aperture, a gas block connected to the barrel and defining a piston bore open in a rearward direction and in communication with the gas block bore, a piston assembly having a forward end operably engaged to the piston bore and a rear end operably engaged to the reciprocating bolt assembly, the piston assembly having a piston closely received in the piston bore and having a piston rear end, the piston assembly including an elongated intermediate rod having an intermediate rod forward end registered with the piston rear end and an intermediate rod rear end, and the piston assembly including a rear portion having a forward end registered with the intermediate rod rear end and a rear portion operably connected to the reciprocating bolt assembly. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
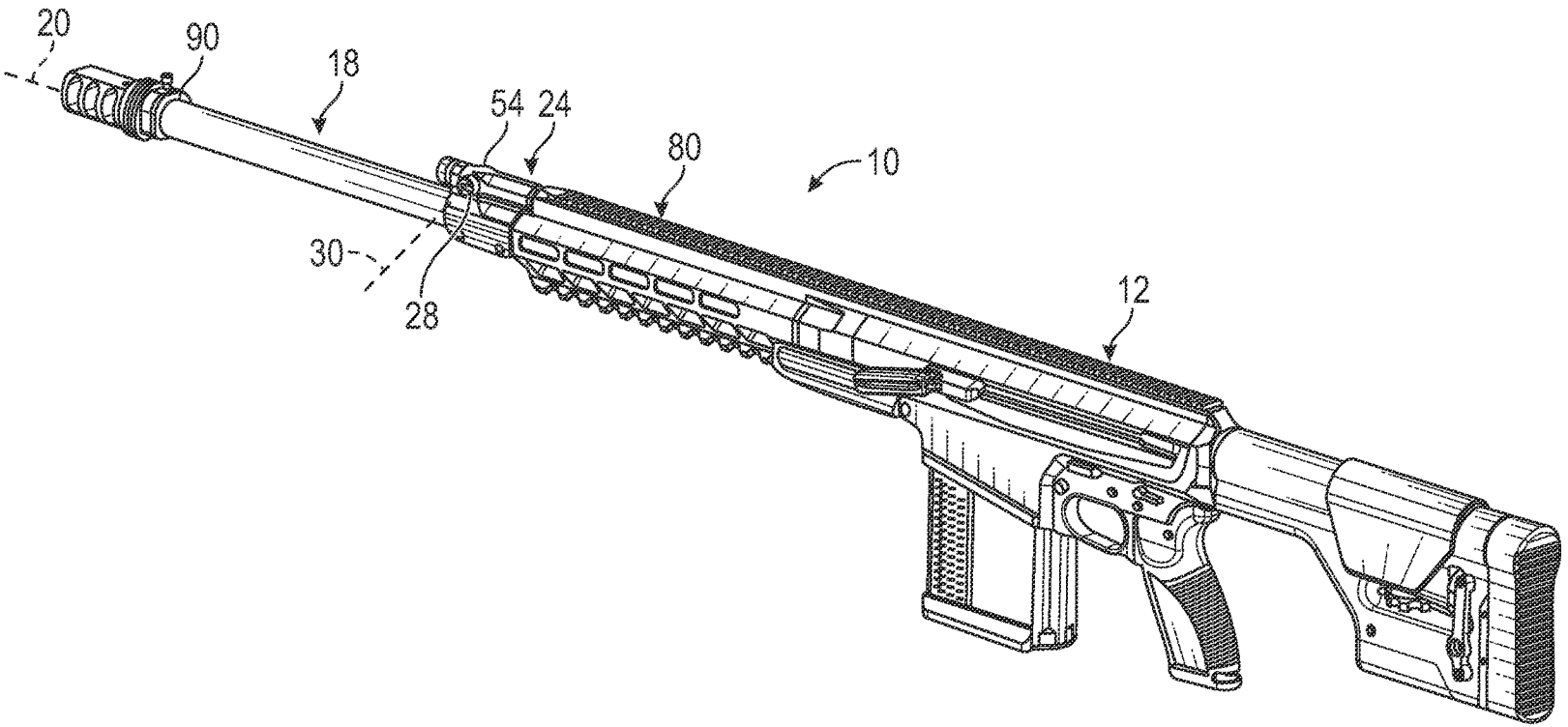
FIG. 1 is a top isometric view of the current embodiment of a firearm with gas piston assembly constructed in accordance with the principles of the present invention.

An embodiment of the firearm with gas piston assembly of the present invention is shown and generally designated by the reference numeral 10.

Figure 2:
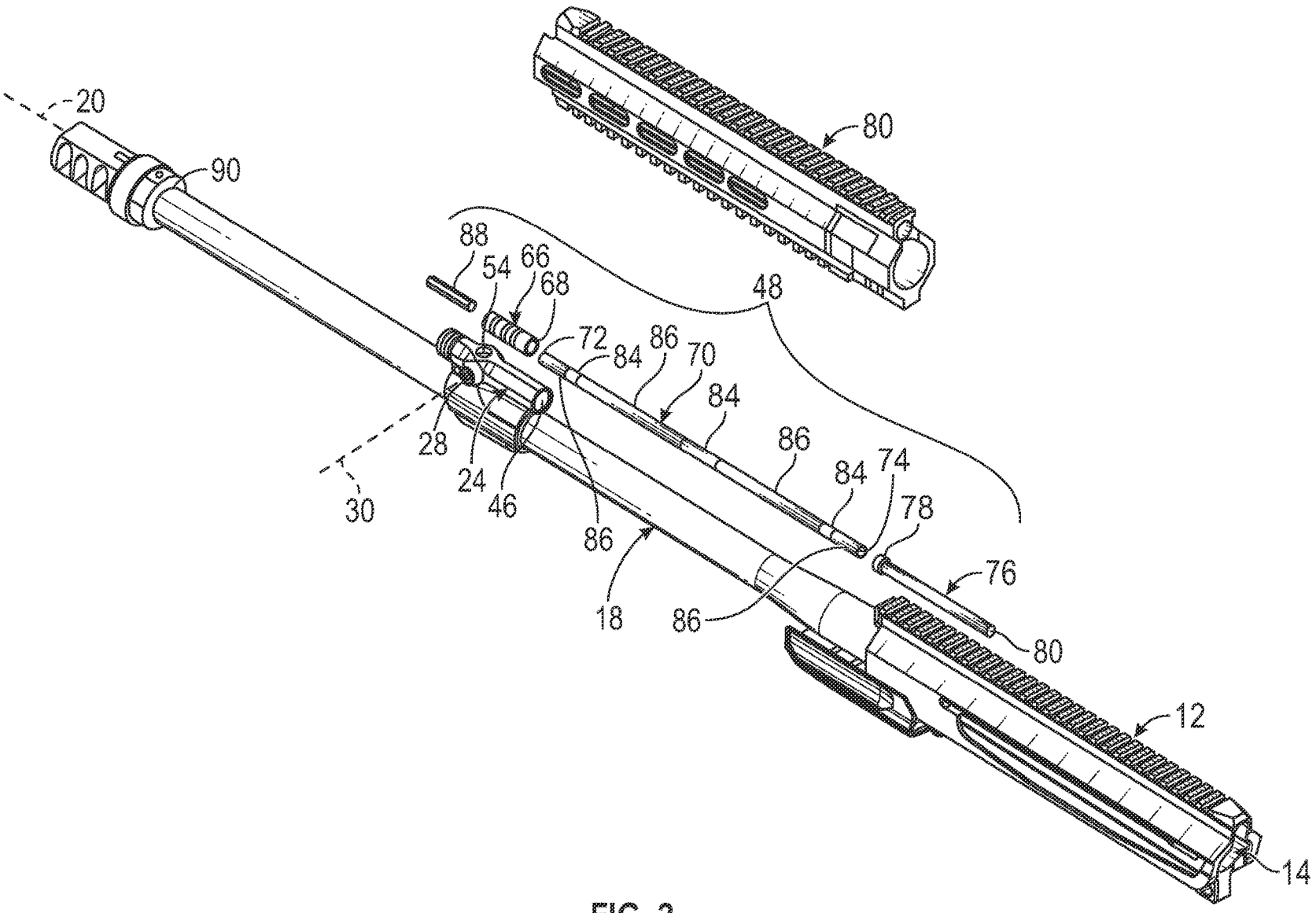
FIG. 2 is an exploded view of the piston assembly of FIG. 1.
Figure 3:
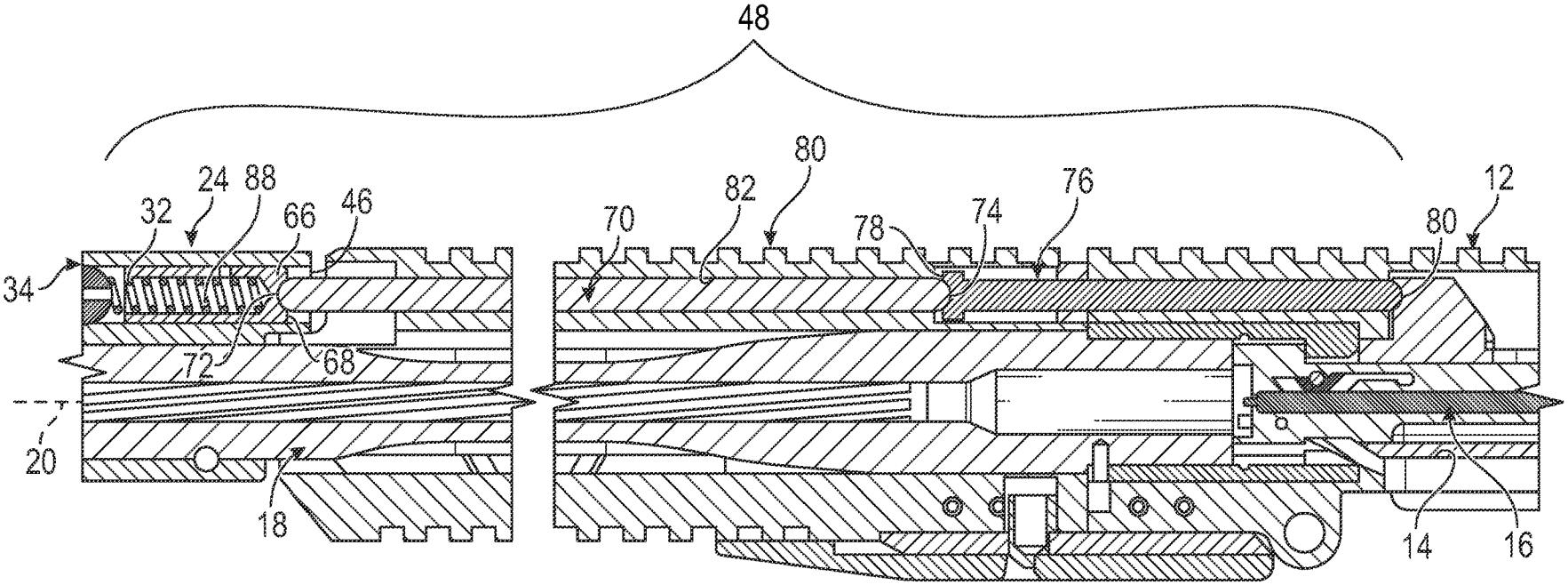
FIG. 3 is a side sectional view of the receiver and barrel of FIG. 1.
Figure 4:
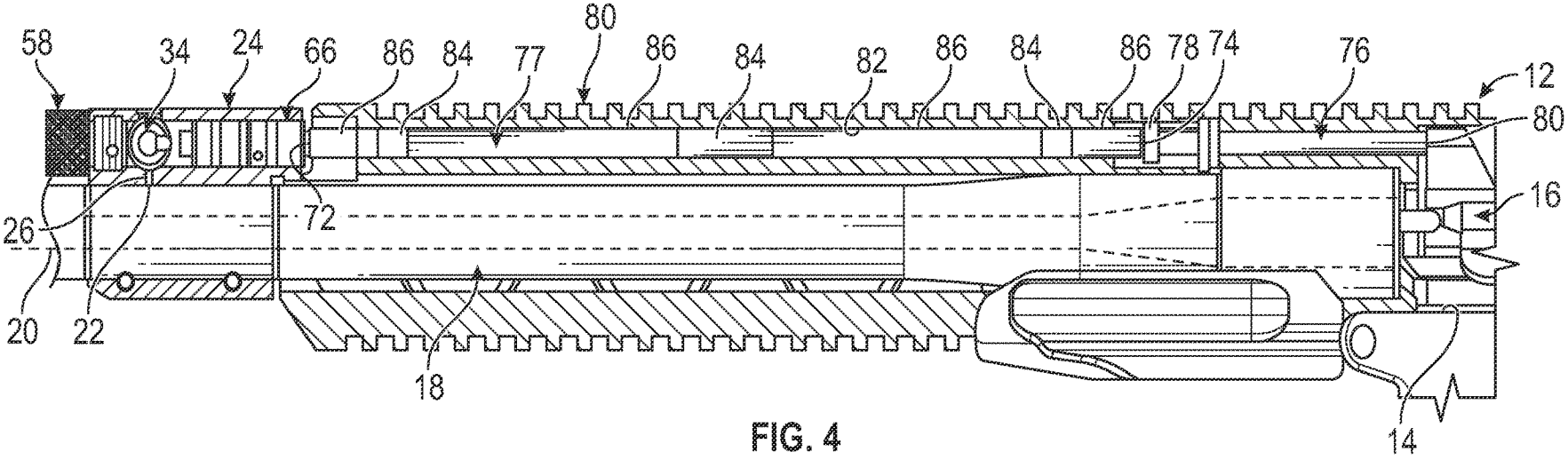
FIG. 4 is a side sectional view of the receiver and barrel of FIG. 1.
Figure 5:
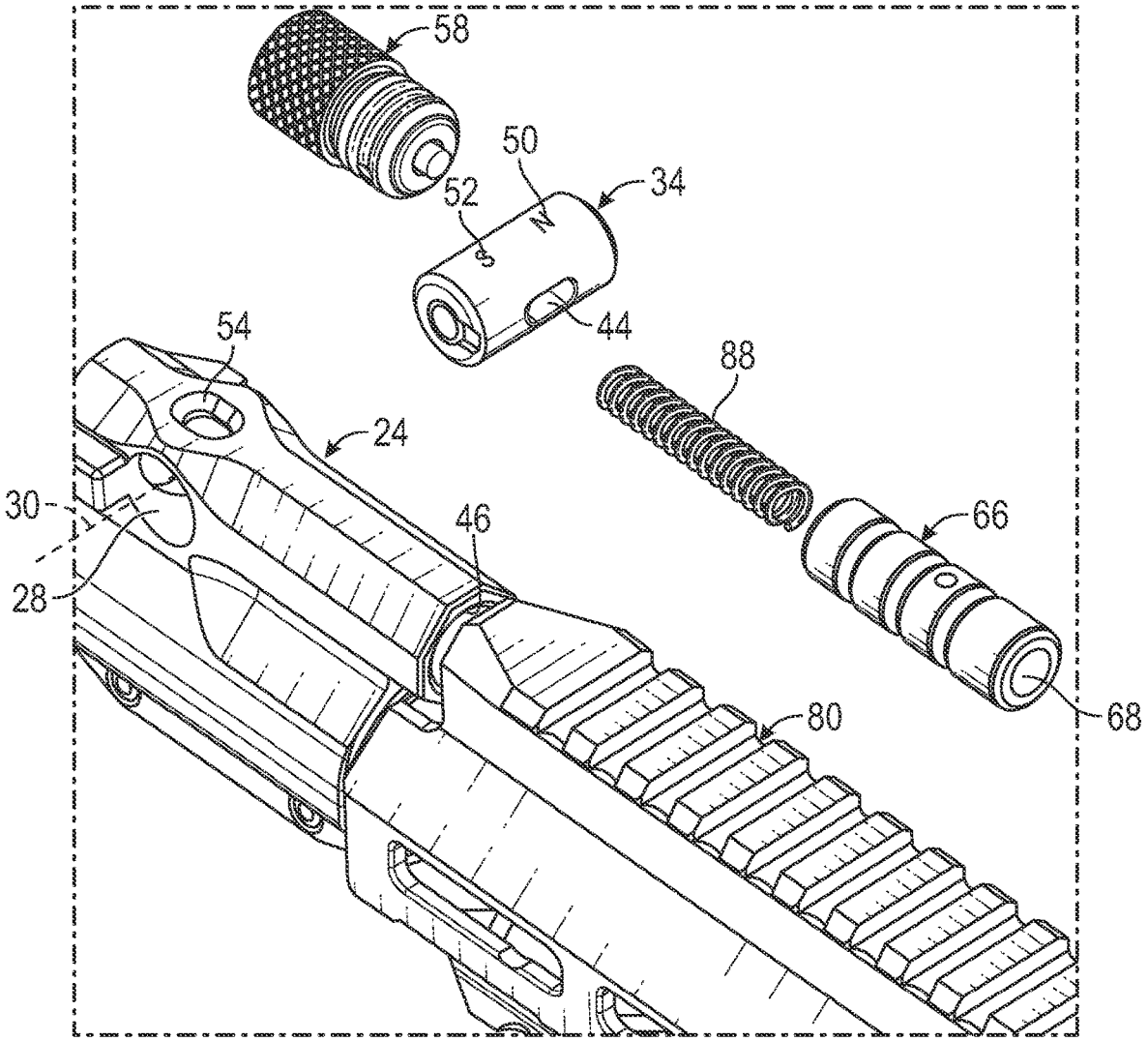
FIG. 5 is an exploded view of the regulator of the firearm of FIG. 1.
Figure 6A:
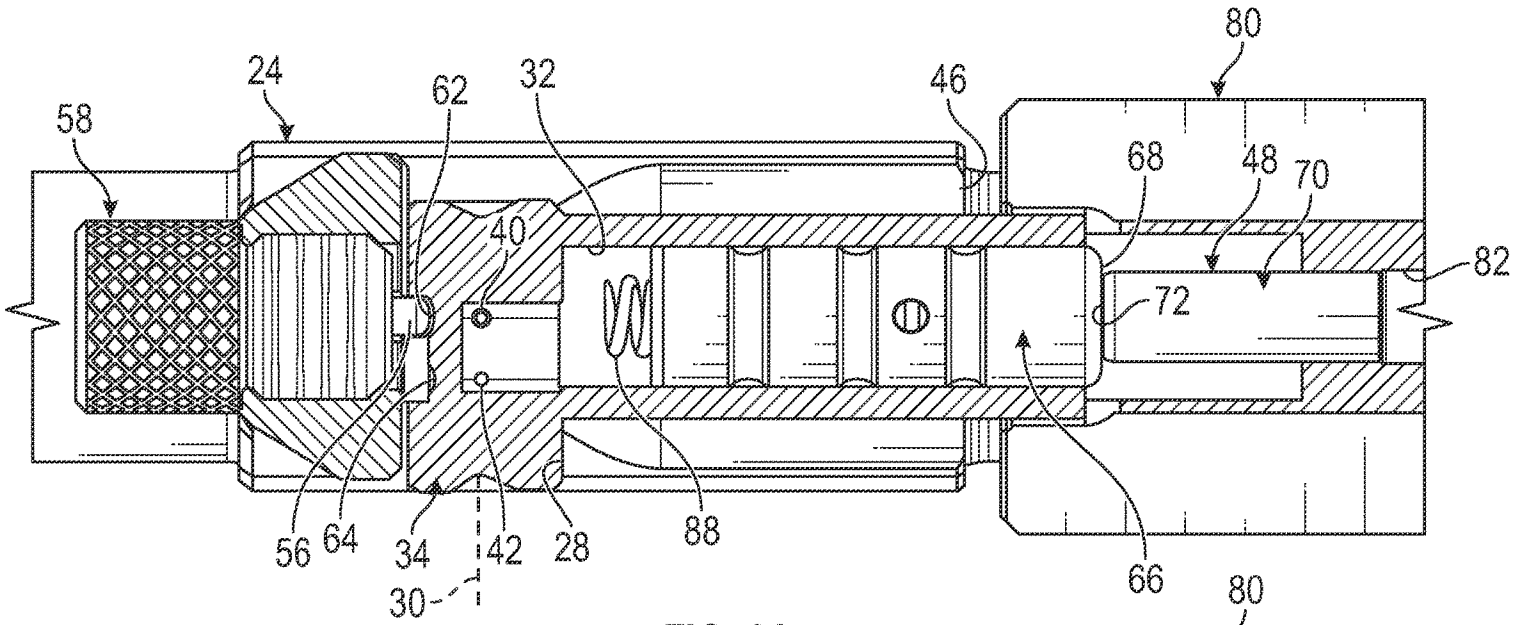
FIG. 6A is a top sectional view of the gas block of FIG. 1 showing the regulator in the position suitable for unsuppressed operation of the firearm.
Figure 6B:
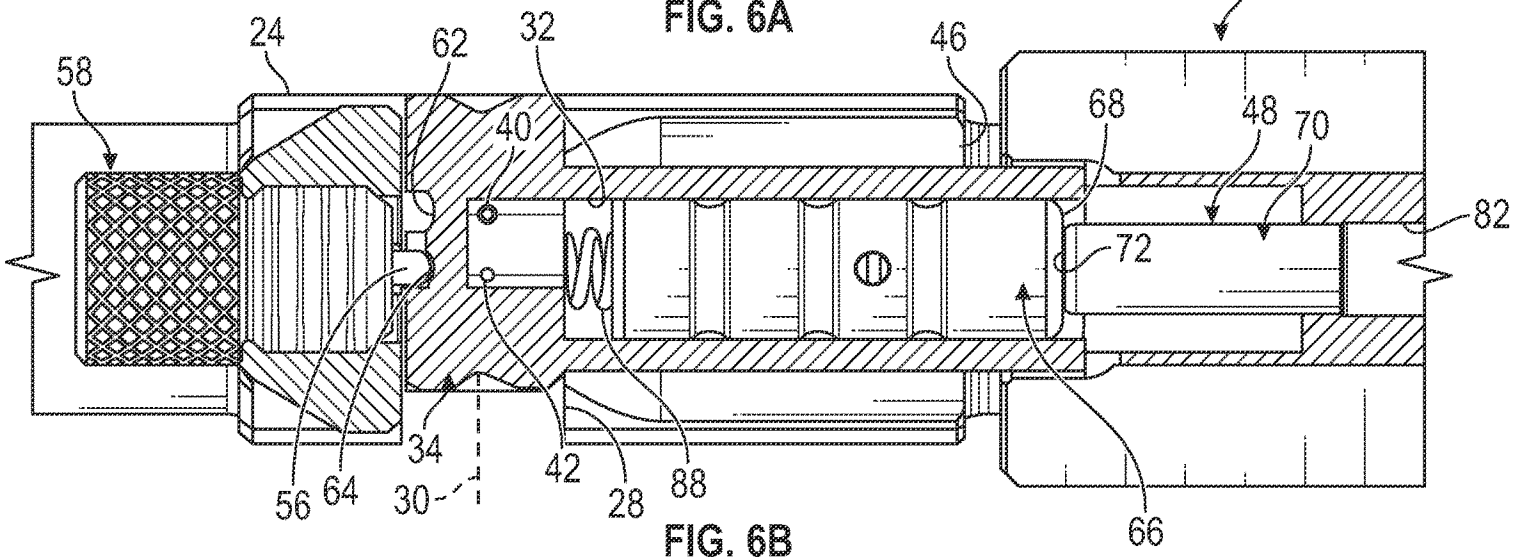
FIG. 6B is a top sectional view of the gas block of FIG. 1 showing the regulator in the position suitable for suppressed operation of the firearm.
Figure 7A:
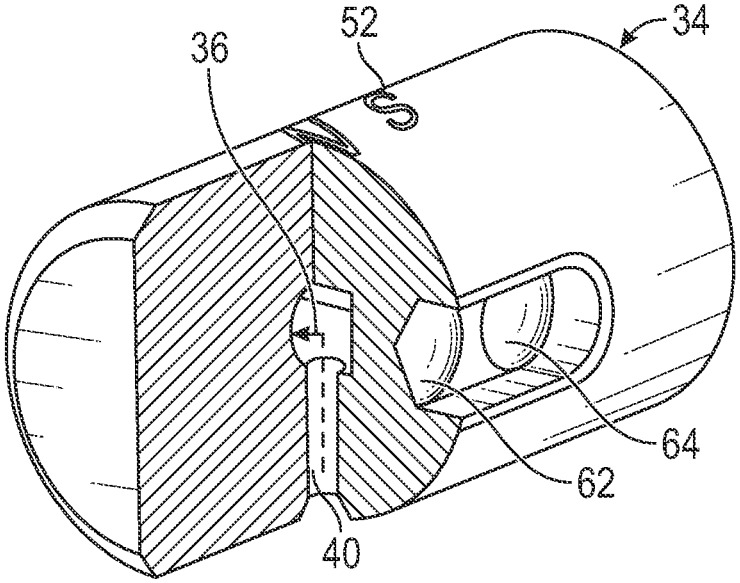
FIG. 7A is an isometric sectional view of the regulator of FIG. 5 cutaway through the orifice for suppressed operation of the firearm.
Figure 7B:
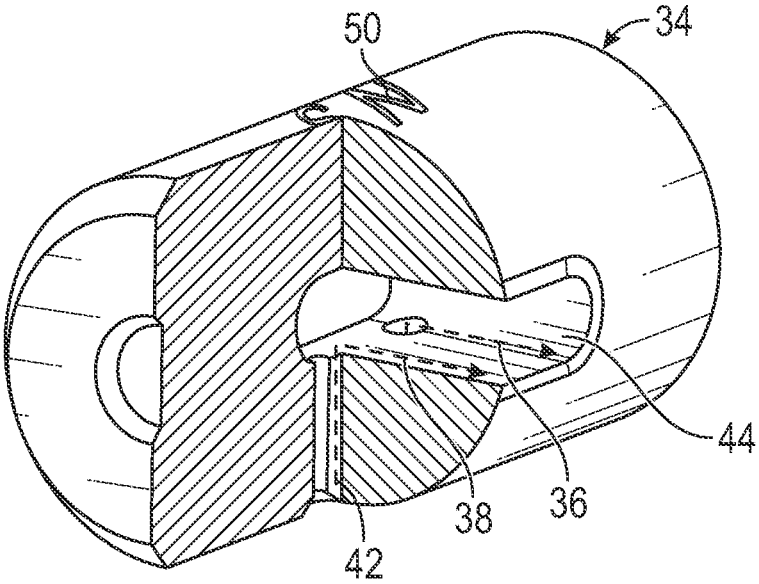
FIG. 7B is an isometric sectional view of the regulator of FIG. 5 cutaway through the orifice for unsuppressed operation of the firearm.
Figure 8:
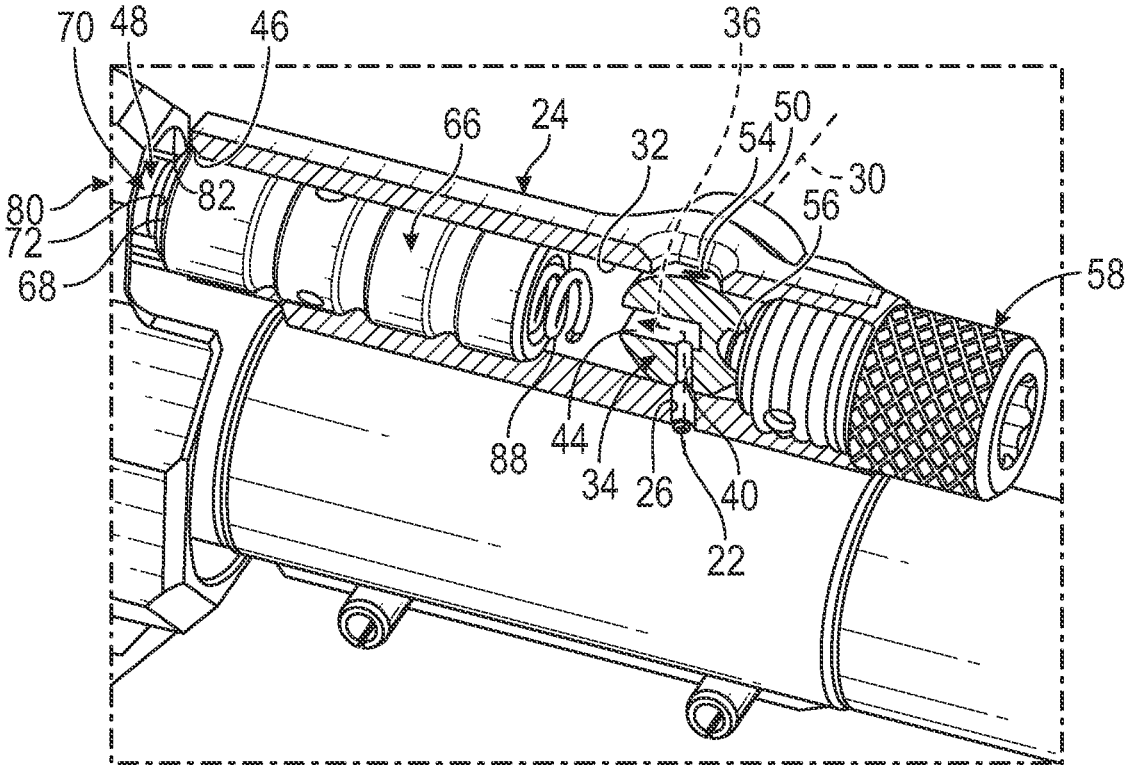
FIG. 8 is an isometric sectional view of the gas block of FIG. 1.
Figure 9:
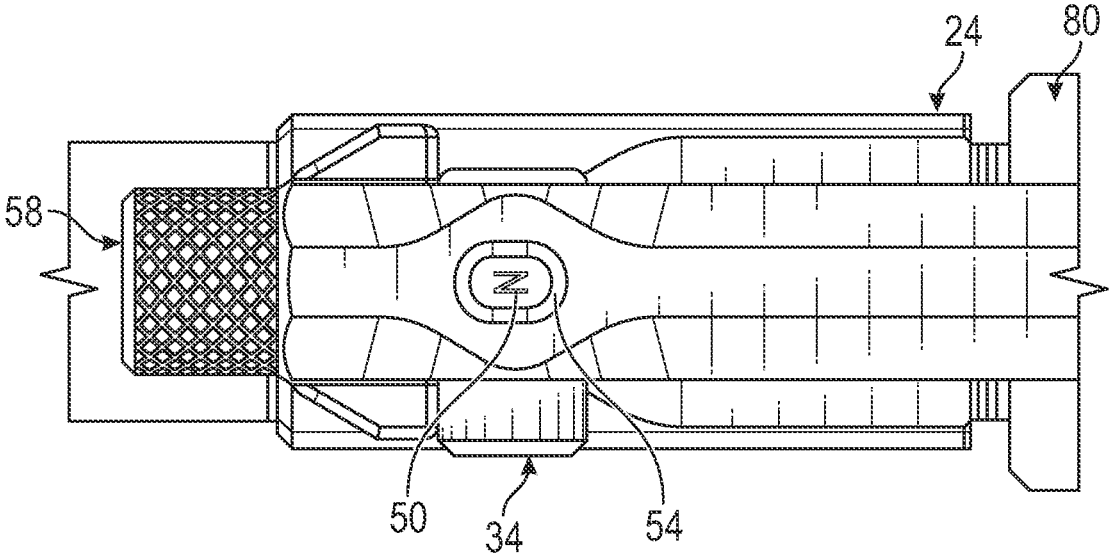
FIG. 9 is a top view of the gas block of FIG. 1.

FIG. 1 illustrates the improved firearm with gas piston assembly 10 of the present invention with the trigger hidden. FIG. 2 illustrates an exploded view of the piston assembly 48. FIGS. 3 & 4 are side sectional views of the receiver 12 and barrel 18. FIG. 5 is an exploded view of the regulator 34. FIG. 6A is a top sectional view of the gas block 24 showing the regulator in the position suitable for unsuppressed operation of the firearm. FIG. 6B is a top sectional view of the gas block showing the regulator in the position suitable for suppressed operation of the firearm. FIG. 7A is an isometric sectional view of the regulator cutaway through the orifice for suppressed operation of the firearm. FIG. 7B is an isometric sectional view of the regulator cutaway through the orifice for unsuppressed operation of the firearm. FIG. 8 is an isometric sectional view of the gas block. FIG. 9 is a top view of the gas block. More particularly, the firearm has a receiver 12 defining a passage 14 receiving a reciprocating bolt assembly 16. A barrel 18 defining a barrel axis 20 extends from the receiver in a forward direction and defines a barrel gas aperture 22. A gas block 24 is connected to the barrel and has a gas block inlet 26 registered with the barrel gas aperture. The gas block defines a gas block bore 28 transverse to the barrel axis and in communication with the gas block inlet. The gas block bore defines a gas block bore axis 30. The gas block also defines a gas outlet 32 in communication with the gas block bore. A regulator 34 is closely received in the gas block bore and is operable to reciprocate along the gas block bore between at least a first position shown in FIG. 6A and a different second position shown in FIG. 6B. The regulator defines a first gas path 36 shown in FIGS. 7A & 8 communicating between the gas block inlet and gas block outlet when the regulator is in the first position. The regulator defines a second gas path 38 also shown in FIG. 7A communicating between the gas block inlet and gas block outlet when the regulator is in the second position. The first gas path and second gas path have different gas flow characteristics, with one being suitable for suppressed operation of the firearm and one being suitable for unsuppressed operation of the firearm in the current embodiment. This is accomplished by one of the first gas flow path and second gas flow path having a greater gas flow restriction than the other of the first gas flow path and second gas flow path. The varying gas flow restriction results from the first gas flow path including a first orifice 40 with a first size and the second gas flow path having a second orifice 42 having a second size different from the first size. In the current embodiment, the second orifice is smaller than the first orifice so the increased gas pressure resulting from suppressed operation of the firearm relative to unsuppressed operation of the firearm does not result in excessive force being exerted upon the piston assembly 48.

The regulator 34 is operable to reciprocate along the gas block bore 28 without rotation. The gas block bore is cylindrical, and the regulator is a cylindrical body, in the current embodiment. However, the regulator could be any shape; cylindrical is preferred to facilitate machining of the matching gas block bore. The regulator defines a manifold 44 in communication with the first and second gas paths 36, 38. The gas block bore axis 30 is perpendicular to the barrel axis 20. The gas block 24 defines a piston bore 46 open in a rearward direction and in communication with the gas block bore and configured to receive a piston assembly 48 having a forward end operably engaged to the piston bore and a rear end operably engaged to the reciprocating bolt assembly 16, which is shown in FIG. 3.

The regulator 34 includes first and second indicia 50, 52, each associated with a respective one of the first and second positions. The first and second indicia are positioned to provide the user with better visibility of them when in the shooting position. The first and second indicia each include a symbol associated with an operative mode. In the current embodiment, "N" represents the regulator position for normal, unsuppressed operation of the firearm 10, and "S" represents the regulator position for suppressed operation of the firearm. Symbols can include alphanumeric symbols and icons. Operative modes can include suppressed, standard (unsuppressed), and fault override (usage of the suppressed setting without a suppressor attached to the muzzle of the firearm to apply additional force to the reciprocating bolt assembly 16 in the event of a malfunction). The gas block defines a window 54, and one of the first and second indicia is visible in the window based on the regulator position ("N" is shown in FIG. 9). A regulator plunger 56 is received in a gas plug 58. The regulator plunger is biased by a regulator plunger spring (not visible) into one of two notches 62, 64 in the regulator. Each notch corresponds to one of the first and second positions to releasably retain the regulator in a selected position while providing tactile feedback when changing the regulator between positions.

The piston assembly 48 has a gas piston 66 closely received in the piston bore 46 and having a piston rear end 68. The piston assembly includes an elongated intermediate rod 70 having an intermediate rod forward end 72 registered with the piston rear end and an intermediate rod rear end 74. The piston assembly also includes a rear portion 76 having a forward end 78 registered with the intermediate rod rear end and a rear portion 80 operably connected to the reciprocating bolt assembly 16.

The firearm with gas piston assembly 10 includes a handguard 80 located between the receiver 12 and barrel gas aperture 22. The handguard defines a handguard rod bore 82 that closely receives the elongated intermediate rod 70 in a close slip fit manner. The intermediate rod forward end 72 extends forward of the handguard rod bore. The intermediate rod rear end 74 extends rearward of the handguard rod bore. The elongated intermediate rod is longer than the handguard rod bore. The elongated intermediate rod includes a plurality of full diameter portions 84 closely received by the handguard rod bore, and also includes a reduced diameter portion 86 between the full diameter portions. The elongated intermediate rod has a largest diameter less than the handguard rod bore diameter.

A spring 88 is located forward of a portion of the gas piston 66. When the reciprocating bolt assembly 16 is in a forward battery condition, the spring is configured to bias the piston assembly 48 components together and against the reciprocating bolt assembly. The spring is configured to compress in response to movement of the reciprocating bolt assembly to the battery position.

Each of the piston assembly 48 components is free of connection to each other except for an abutting connection. Thus, each of the piston assembly components are disconnected and separable from each other. The piston assembly components can be easily adjusted for use with a firearm having a larger caliber, which requires more distance between the receiver 12 and the barrel gas aperture 22 to obtain the correct gas pressure to cycle the reciprocating bolt assembly 16 reliably without causing excessive wear, by replacing just the handguard 80 and the elongated intermediate rod 70 with longer versions.

The piston assembly 48 has numerous benefits, including ease of manufacturing by simple turning components, the overall length being spread over multiple components, and the modular design enabling usage of different materials. The elongated intermediate rod 70 is fully guided within the handguard rod bore 82, so any longitudinal loads could exceed the limit of flexure without disrupting operation. As a result, the elongated intermediate rod can be designed with a higher length-to-diameter ratio than is conventional. Because the elongated intermediate rod is operating and being guided directly within the handguard rod bore, a substantially lower adapter-rail-to-bore-axis can be achieved. The separated gas operation design of the piston assembly is less sensitive to gas block 24 to receiver hole angular or concentricity deviation. Furthermore, because the elongated intermediate rod is disconnected from the gas piston 66 after the initial impulse transfer, the barrel 18 is left freely floating afterwards for increased accuracy of the firearm 10. The spring 88 provides positive contact between the gas piston, elongated intermediate rod, rear portion 76, and reciprocating bolt carrier 16. No gap between the piston assembly components exists. Therefore, the impulse transfer, when operating the reciprocating bolt carrier, is realized shock-free, unlike traditional gas piston designs.

In the context of the specification, the terms "rear" and "rearward," and "front" and "forward" have the following definitions: "rear" or "rearward" means in the direction away from the muzzle 90 of the firearm while "front" or "forward" means it is in the direction towards the muzzle of the firearm.

While a current embodiment of a firearm with gas piston assembly has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly, and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm comprising:

a receiver defining a passage receiving a reciprocating bolt assembly;

a bolt carrier key having a forward facing surface;

a barrel defining a barrel axis and extending from the receiver in a forward direction and defining a barrel gas aperture;

a gas block connected to the barrel and defining a piston bore open in a rearward direction and in communication with the gas block bore;

a piston assembly having a forward end operably engaged to the piston bore and a rear end operably engaged to the reciprocating bolt assembly;

the piston assembly having a piston closely received in the piston bore and having a piston rear end;

the piston assembly including an elongated intermediate rod having an intermediate rod forward end registered with the piston rear end and an intermediate rod rear end;

the rear end portion of the piston assembly configured to abut the forward facing bold carrier key surface; and the piston assembly including an elongated rear portion having a forward end registered with the intermediate rod rear end and a rear portion operably connected to the reciprocating bolt assembly, wherein each of the piston, the intermediate rod, and the rear portion is free of connection to each other except for an abutting connection free of securement absent an applied axial force.

2. The firearm of claim 1 including a handguard between the receiver and barrel gas aperture, and defining a handguard rod bore, closely receiving the elongated intermediate rod.

3. The firearm of claim 2 wherein the intermediate rod forward end extends forward of the handguard rod bore.

4. The firearm of claim 2 wherein the intermediate rod rear end extends rearward of the handguard rod bore.

5. The firearm of claim 2 wherein the elongated intermediate rod is longer than the handguard rod bore.

6. The firearm of claim 2 wherein the elongated intermediate rod includes a plurality of full diameter portions closely received by the handguard rod bore, and including a reduced diameter portion between the full diameter portions.

7. The firearm of claim 1 including a spring forward of a portion of the piston and when the reciprocating bolt assembly is in a forward battery condition, the spring is configured to bias the piston, the intermediate rod, and the rear portion together and against the reciprocating bolt assembly.

8. The firearm of claim 7 wherein the spring is configured to compress in response to movement of the reciprocating bolt assembly to the battery position.

9. The firearm of claim 2 wherein the elongated intermediate rod has a largest diameter less than a handguard rod bore diameter.

10. The firearm of claim 1 wherein each of the piston, the intermediate rod, and the rear portion is separable from each other.

11. A firearm comprising:

a receiver defining a passage receiving a reciprocating bolt assembly;

a bolt carrier key having a forward facing surface;

a barrel defining a barrel axis and extending from the receiver in a forward direction and defining a barrel gas aperture;

a gas block connected to the barrel and defining a piston bore open in a rearward direction and in communication with the gas block bore;

a piston assembly having a forward end operably engaged to the piston bore and a rear end operably engaged to the reciprocating bolt assembly;

the piston assembly having a piston closely received in the piston bore and having a piston rear end;

the piston assembly including an elongated intermediate rod having an intermediate rod forward end registered with the piston rear end and an intermediate rod rear end;

the rear end portion of the piston assembly configured to abut the forward bolt carrier key surface;

the piston assembly including a rear portion having a forward end registered with the intermediate rod rear end and a rear portion operably connected to the reciprocating bolt assembly; and the piston, the intermediate rod, and the rear portion do not overlap each other.

12. The firearm of claim 11 including a handguard between the receiver and barrel gas aperture, and defining a handguard rod bore, closely receiving the elongated intermediate rod.

13. The firearm of claim 11 including a spring forward of a portion of the piston and when the reciprocating bolt assembly is in a forward battery condition, the spring is configured to bias the piston, the intermediate rod, and the rear portion together and against the reciprocating bolt assembly.

14. The firearm of claim 11 wherein each of the piston, the intermediate rod, and the rear portion is free of connection to each other except for an abutting connection.

* * * * *